US011008149B2

(12) United States Patent
Rabinovich et al.

(10) Patent No.: US 11,008,149 B2
(45) Date of Patent: May 18, 2021

(54) INFLATABLE PACKAGING BOX

(71) Applicants: Michael Rabinovich, Solon, OH (US); Aleksey Rabinovich, Solon, OH (US)

(72) Inventors: Michael Rabinovich, Solon, OH (US); Aleksey Rabinovich, Solon, OH (US)

( * ) Notice: Subject to any disclaimer, the term of this patent is extended or adjusted under 35 U.S.C. 154(b) by 0 days.

(21) Appl. No.: 16/531,199

(22) Filed: Aug. 5, 2019

(65) Prior Publication Data

US 2020/0039722 A1 Feb. 6, 2020

Related U.S. Application Data

(60) Provisional application No. 62/714,165, filed on Aug. 3, 2018.

(51) Int. Cl.
*B65D 81/05* (2006.01)

(52) U.S. Cl.
CPC ..... *B65D 81/052* (2013.01)

(58) Field of Classification Search
CPC .... B65D 81/052; B65D 81/051; B65D 81/05; B65D 25/10; B65D 25/101; B65D 81/127
USPC ..... 206/522, 521; 383/3
See application file for complete search history.

(56) References Cited

U.S. PATENT DOCUMENTS 3,889,743 A * 6/1975 Presnick ..... B65D 81/3858 165/46
5,180,060 A * 1/1993 Forti ..... B65D 81/052 206/522
5,624,035 A * 4/1997 Kim ..... B65D 81/052 206/521
6,398,029 B1 * 6/2002 Farison ..... B65D 81/052 206/522
6,513,658 B1 * 2/2003 Adkins ..... B65D 81/052 206/522
7,568,324 B2 * 8/2009 Bussey, III ..... B65B 55/20 206/522
7,913,847 B2 * 3/2011 Kasboske ..... B65D 81/052 206/522
7,931,402 B1 * 4/2011 Oas ..... B65D 81/052 383/3
2003/0006162 A1 * 1/2003 Smith ..... B65D 81/027 206/522
2006/0219723 A1 * 10/2006 Wang ..... B65D 81/052 220/592.27

(Continued)

FOREIGN PATENT DOCUMENTS

WO WO-2014057772 A1 * 4/2014 ..... A61K 31/444

OTHER PUBLICATIONS

English translation of WO 2014/057772 A1 (Year: 2017).*

*Primary Examiner* — Steven A. Reynolds
(74) *Attorney, Agent, or Firm* — Daniel M. Cohn; Howard M. Cohn

(57) ABSTRACT

An inflatable packaging box to protect an item during storage and shipment, including a plurality of sidewalls, and a chamber formed within the plurality of sidewalls adapted to receive the item. An opening through at least one of the plurality of sidewalls is included, through which the chamber is accessible. A plurality of films are each secured to one of the plurality of sidewalls. Each of the plurality of films forming one of a series of elongated sections which form the chamber in the space between the series of elongated sections. Each of the series of elongated sections are inflatable to conform to the item's shape.

16 Claims, 5 Drawing Sheets

(56) References Cited

U.S. PATENT DOCUMENTS

2014/0224699 A1* 8/2014 Smith ..... B65B 5/06
206/522

* cited by examiner

INFLATABLE PACKAGING BOX

CROSS REFERENCE TO RELATED APPLICATIONS

This application claims the benefit of U.S. Provisional Patent Application No. 62/714,165 filed on Aug. 3, 2018, which is incorporated in its entirety by reference herein.

TECHNICAL FIELD OF THE INVENTION

The present invention relates to an inflatable packaging box, and more particularly to an inflatable packaging box that molds to the shape of the item being packaged.

BACKGROUND OF THE INVENTION

Protective packaging assemblies are often used when an object or article to be packaged requires protection from physical shock or other hazards, such as vibration, weather, or abrasion. For example, when shipping an object that is relatively fragile it is often desirable to package the object inside a box to protect the object from physical damage that may occur during loading, transit, and unloading. Shipped articles can come in all sizes and shapes. These articles can be fragile or hardy (i.e., the article is considered non-fragile). To add additional protection, protective packaging material is often placed within the box.

There are numerous types and forms of protective packaging material for this purpose including paper or plastic dunnage and air-cushioning or foam-cushioning structures. In general, the packaging material is intended to control the movement of the object within the box and/or provide a cushioning layer between the object and the box in order to soften or absorb the effects of a physical impact to the box. However, all of the packaging materials mentioned before can cause waste disposal and recycling issues.

In order to be effective, the packaging material typically must engage enough of the object to hold it substantially in place and engage the areas of the object likely to bear the physical impact. However, concern about not having enough packaging material, often causes users to compensate by using a great deal more packaging material than necessary. Essentially, this extra packaging material is being wasted and shipped. Alternatively, a user may not use or place enough of the packaging material in the box or, more specifically, position the packaging material in the proper areas to provide for effective protection of the object during transit. Also, in many cases, the packaging material itself might move around during transit and, thus, create protection issues. Separate packaging material, such as structural cardboard shell and foam or air cushioning material packing around the object make it difficult to automate the object shipping process.

In the process of shipping an article from one location to another, the article is typically placed in a container along with the protective packaging material to fill the voids about the article and to cushion the article during the shipping process. One common protective packaging material is comprised of a plurality of plastic foam, peanut shaped members which are commonly known as "Styrofoam peanuts."

However, while Styrofoam peanuts have been widely accepted in the packaging industry, they are not without disadvantages. For example, the light weight and flowability of the Styrofoam peanuts results in heavier objects gravitating through the peanuts to the bottom of the container where the object can be damaged. Also, while the flowability of the Styrofoam peanuts facilitates the introduction of the peanuts in the container, the receiver of the package is left with having to deal with the peanuts upon removal of the article from the container in the form of having to clean up the mess left by the peanuts which are easily scattered upon removal of the article from the container.

SUMMARY OF THE INVENTION

According to an embodiment of the present invention, there is disclosed an inflatable packaging box to protect an item during storage and shipment. The inflatable packaging box includes a plurality of sidewalls, and a chamber formed within the plurality of sidewalls adapted to receive the item. An opening through at least one of the plurality of sidewalls is included, through which the chamber is accessible. A plurality of films are each secured to one of the plurality of sidewalls. Each of the plurality of films forming one of a series of elongated sections which form the chamber in the space between the series of elongated sections. Each of the series of elongated sections are inflatable to conform to the item's shape.

According to an embodiment of the present invention, there is disclosed an inflatable packaging box to protect an item during storage and shipment. The inflatable packaging box includes a plurality of rectangular sidewalls, each formed of non-stretchable plastic. A chamber is formed within the plurality of rectangular sidewalls adapted to receive the item. An opening is formed through at least one of the plurality of rectangular sidewalls through which the chamber is accessible. A plurality of flexible plastic films are each secured to one of the plurality of rectangular sidewalls. Each of the plurality of flexible plastic films form one of a series of elongated sections which form the chamber in the space between the series of elongated sections. Each of the series of elongated sections are inflatable to conform to the item's shape.

BRIEF DESCRIPTION OF THE DRAWINGS

The structure, operation, and advantages of the present invention will become further apparent upon consideration of the following description taken in conjunction with the accompanying figures (FIGS.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader and should not in any way be interpreted as limiting.

DETAILED DESCRIPTION OF THE PREFERRED EMBODIMENTS

Figure 1:
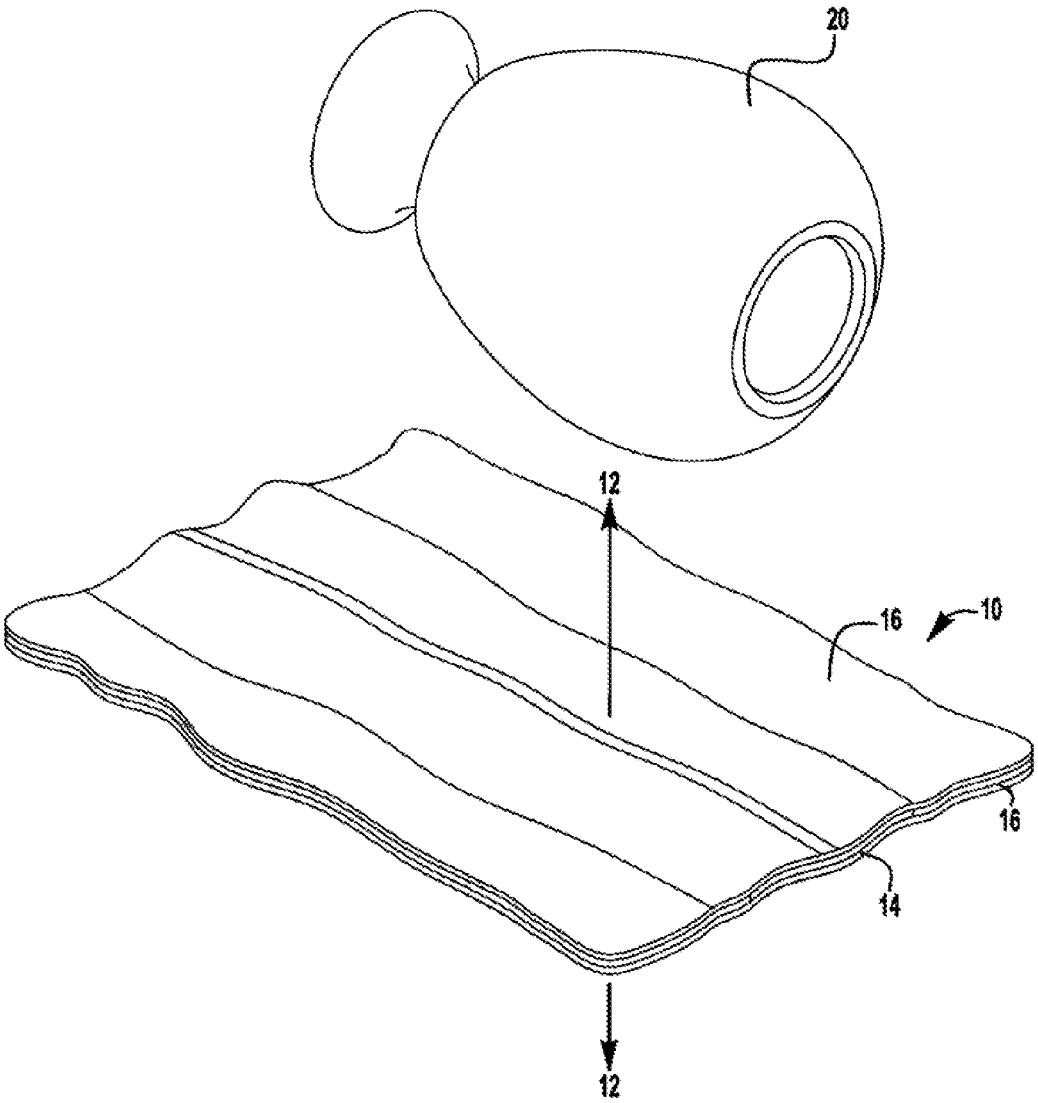
FIG. 1 is a top, three-dimensional view of the inflatable packaging box and an item to be packed therein, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

FIG. 1 depicts a top, cross sectional view of an inflatable packaging box 10. In general terms, the inflatable packaging box 10 is designed to protect one or more fragile items 12 during storage and/or shipment. The inflatable packaging box 10 replaces the need for internal packing material because it adjusts to the contours to the item 12 being packaged and can at the same time replace the conventional exterior structural component (i.e. cardboard box).

The inflatable packaging box 10 is advantageous over traditional packaging, since it combines and replaces the need for a shipping box and filler. This novelty makes automation easier, increasing package processing speed, eliminating an extra step of handling, as well as reduces shipping costs by minimizing the weight and volume through customization. The inflatable packaging box 10 has a first condition prior to the series of elongated sections, as described hereinafter, being inflated; and a second condition wherein the series of elongated sections are inflated and conform to the item's shape.

A plurality of sidewalls 16, including sidewalls 16*a*, 16*b*, 16*c*, 16*d*, 16*e*, 16*f* (16*a*-16*f*) of the box 10 are initially pulled apart or separated from each other, as indicated by arrows 12 shown in FIG. 1, so that the opening 14 in one or more of the sidewalls, i.e. 16*e* is open to the chamber 18 formed within the box 10 when the sidewalls 16 are pulled apart from each other. Preferably the plurality of sidewalls 16 are rectangular in shape such that the packaging box 10 is rectangular in shape. The plurality of sidewalls 16 are durable, generally non-stretchable plastic. While the box 10 is in the deflated condition, as shown in the side view of FIG. 2, the item 20 to be shipped, can then be inserted through the opening 14 into the chamber 18 as shown in FIG. 2.

A plurality of flexible films 22 are secured, one to each of the durable, generally non-stretchable plastic sidewalls 16. The flexible film 22 can be formed of a series of elongated sections 22*a*, 22*b*, 22*c*, 22*d* (22*a*-22*d*) which are secured at their ends to the intersection of adjoining sidewalls, such as 16*a* to 16*b*, where the ends of the elongated sections 22*a* and 22*d* are secured. The outer edges of elongated sections 22*a*-22*d* can be interconnected with the end side walls 16*e* and 16*f*. The series of elongated sections 22*a*-22*d* form the chamber 18 in the space between the series of elongated sections. The item 20 can be placed within the chamber 18 between the sidewalls 22*a*-22*d* within the uninflated box 10, as shown in FIG. 2.

Figure 2:
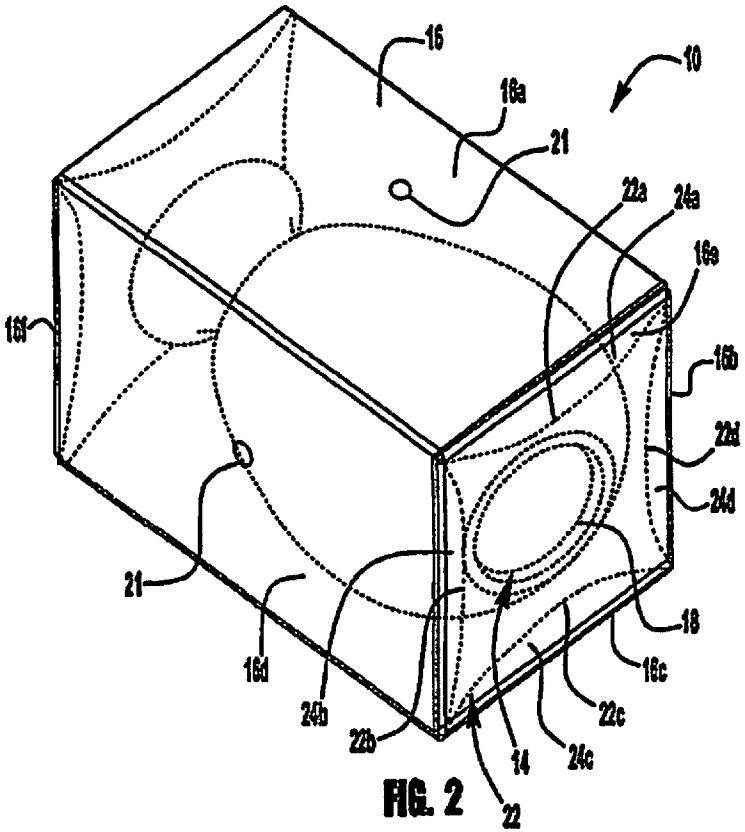
FIG. 2 is a top, three-dimensional view of the inflatable packaging box, in accordance with the present invention.
Figure 3:
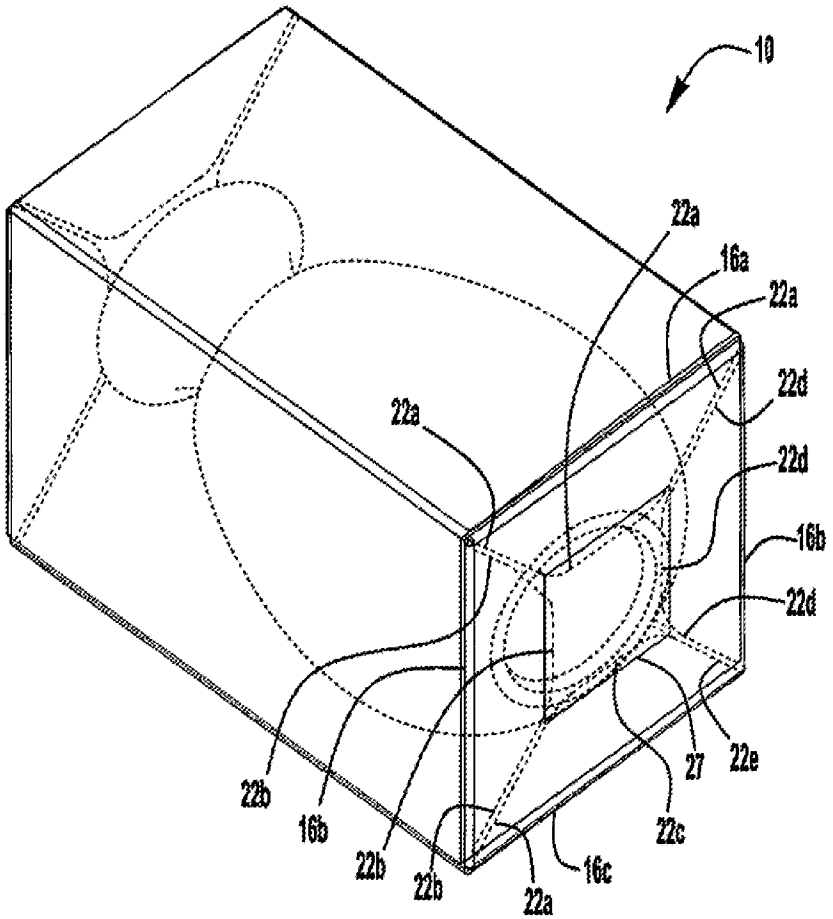
FIG. 3 is a top, three-dimensional view front, cross sectional view of the inflatable packaging box with an item packed therein, in accordance with the present invention.

After the item 20 is placed within the uninflated box 10, as shown in FIG. 2, the elongated sections 22*a*-22*d* of flexible film 22 are then inflated so that they conform to the shape of the item 20, as shown in FIG. 3. It must be noted that it is within the terms of the embodiment that the elongated sections 22*a*-22*d* of film 22 not be flexible.

The space between the elongated sections 22*a*-22*d* of the flexible film 22 and the plastic sidewalls 16*a*-16*d* can be inflated with a gas, such as air or carbon dioxide, or any other substance such as a gel so that the sections 22*a*-22*d* of flexible film press against the item 20 and substantially take the shape of the item to be shipped. The inflation of the elongated sections 22*a*-22*d* of the flexible film 22 can be accomplished by inserting the inflation material though an sealed opening 20 in each of the non-stretchable plastic walls 16 (two sealed openings 20 are shown in walls 16*a* and 16*d* on FIG. 2) or alternatively through one sealed opening 20 and then through holes in the film forming the sections 22*a*-22*d*.

Once the spaces between the series of sections 22*a*-22*d* of the flexible film 22 and the non-stretchable plastic walls 16 are inflated, the opening 14 in end wall 16*e* can be closed with a seal member 27, by any means such as a shipping label and the now inflated box is ready to be shipped. The advantage of the present design is that once the item is secured within the box 10, as shown in FIG. 3, no additional packaging material is necessary.

The inflatable packaging box 10 is versatile, as it can be designed to handle a variety of shapes and sizes of the item 20 being shipped by varying the amount of empty packing space between the flexible film 22 while holding the outside dimensions of the preferably non-stretchable plastic walls 16*a*-16*f* of the box 10 fixed. Any appropriate material may be utilized for the walls 16-16*f*, such as rubber polymer, elastomer, and cellulose.

Alternatively, the inflatable box 10 can have a custom design using an algorithm and design parameters so that an automated system can create a fixed padding thickness between the flexible walls 22 and the non-stretchable plastic walls 16 based on the dimensions of the item 20 to be shipped to minimize volume (i.e. custom outside dimensions, while providing for example, a one inch padding around the shipped item). Depending on the amount of protection for the item 20 required, the designs could accommodate non-fragile to fragile items on demand, making it possible to create an optimal packing design to an International Shipping Standard on demand.

The box 10 can also replace a waterproof liner or material, eliminating a possible third component. The inflatable packaging box 10 greatly reduces the packaging weight, volume and optimizes on the amount of padding need for an item, and can be easily made waterproof, automated and modular. The inflatable packaging box 10 makes automation easy to implement over a traditional cardboard box and filler because the packaging generation, item placement, inflation, and labeling can be done in the same location or on the same assembly line. It's understood that the box 10 may be any desired shape, since the box is formed about the item 20 to be shipped, and inflates to add protection.

The inflatable box 10 can be made to waterproof to cover transportation, delivery, and storage, as well as protecting against insects and rodents, which can make their way into a traditional cardboard box during storage or shipment. Preferably, the box 10 is constructed of environmentally friendly material, in order to reduce the cost necessary to recycle or dispose of the box. Typically, the box 10 is constructed of a plastic or plastic polymer. The plastic may be transparent for safety screening, or opaque to have the contents of the box remain discreet. Further, the plastic may be designed to be insect and pest proof.

The construction material of the box 10 may be vibration and sound insulating and dampening, as well as specifically designed to control the moisture content within the box 10. It is within the terms of the embodiment that there be a reflective coating applied to the external surface of the walls 16 of the box 10, as well as any other appropriate decorative markings.

The inflatable box 10 takes up very little space before it is inflated as shown in FIG. 1 and only assumes the shape of the item being shipped after it is inflated. The box 10 simplifies procuring and disposing of the box in comparison to the traditional cardboard box and filler method. The inflatable packaging can be created on-site.

Figure 4:
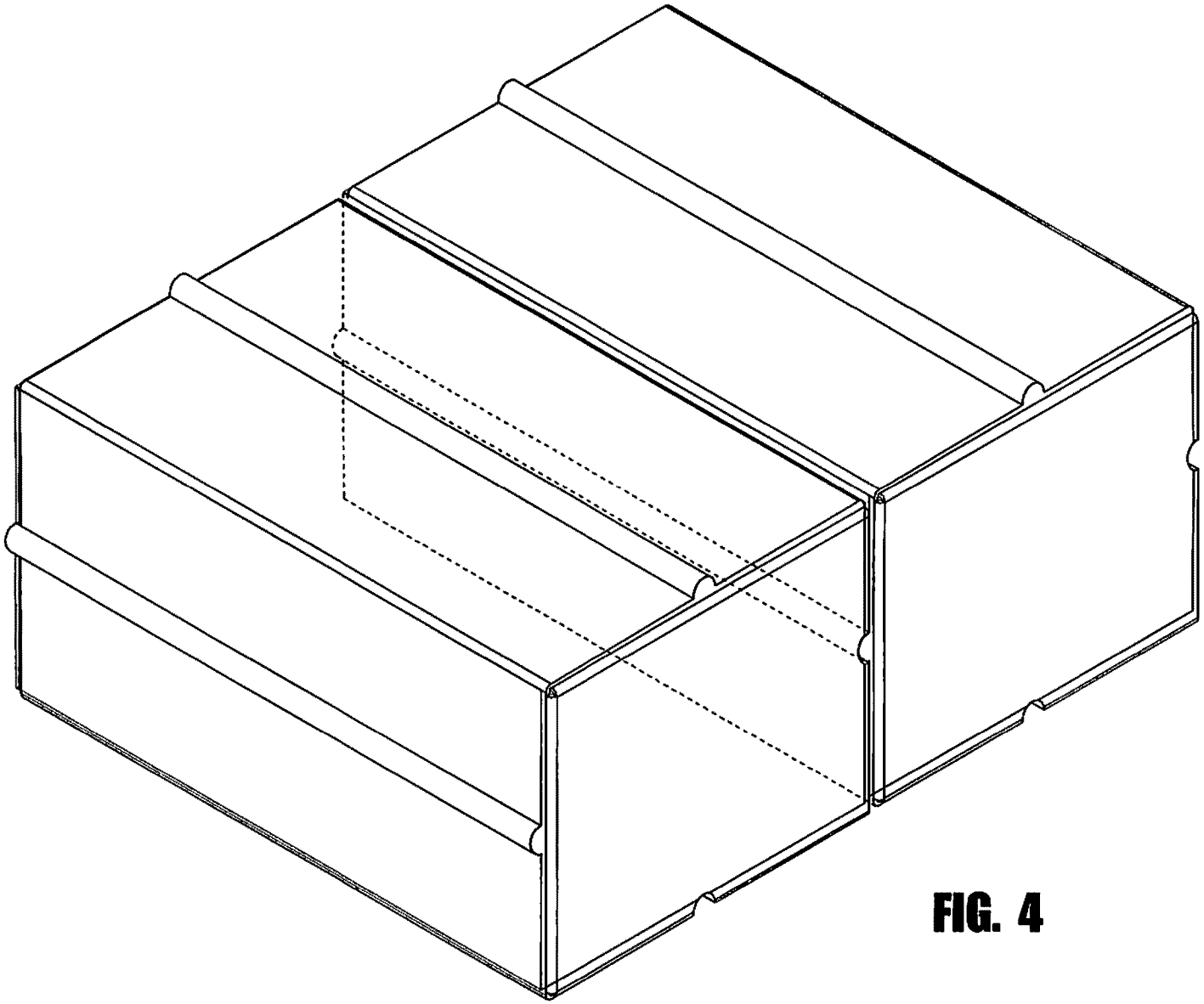
FIG. 4 top, three-dimensional view of two inflatable packaging box interconnected with each other, in accordance with the present invention.

As seen in FIG. 4, the inflated box 10 can be designed to be stackable, modular to snap, or fasten together to minimize movement during shipping. After the item 12 has been placed within the deflated box 10, and it has been inflated, a label can be used to cover the opening, or the top could be sealed.

Prior to sealing, the chamber 18 within inflatable box 10 may be filled with a substance such as solid carbon dioxide, ice, or gel to keep the item cold. Alternatively, the item 12 could be kept warm or cold using chemical or electrical energy. Further, the chamber 18 within inflatable box 10 can be filled with a fire retardant material, both for extinguishing warehouse fires, and preserving the contents of the box.

Figure 5:
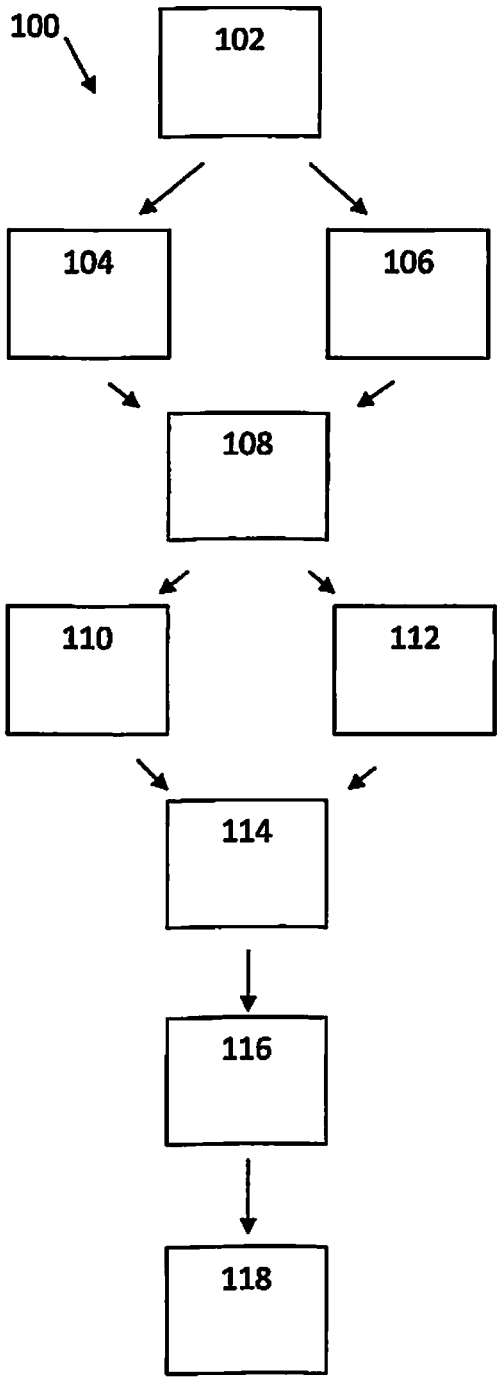
FIG. 5 is a flow chart of the method by which the inflatable packaging box is utilized, in accordance with the present invention.

FIG. 5 is a flow chart illustrating the method 100 by which the inflatable box 10 is utilized. First, in Step 102, the appropriate sized deflated box 10 is selected. This may be done in an assortment of ways. In Step 104, there may a variety of pre-formed box 10 sizes, such as small, medium, large, XL, etc. Depending on the size of the item 20 to be shipped, the appropriate deflated box 10 is chosen. Alternatively, in Step 106, a custom sized deflated box 10 may be custom built based on the size and shape of the item 20 to be shipped.

In Step 108, the item 20 is placed within the deflated box 10. This may be done via an automated process, such as a conveyer belt, as in Step 110. Alternatively, the item 20 may be placed by hand within the deflated box 10, shown in Step 112.

In Step 114, the box 10 is inflated so that the sections 16*a*-16*d* of the flexible film 16 are pressed against the item 120 to thereby protect the item 12.

In Step 116, the box 10 is sealed and labeled, and any customized marketing and printing may be placed on the box 10 so that the box is prepared for shipping. The inflatable box could also replace the primary product packaging for an item by including product picture, information, and marketing materials on the outside of the box.

Clear packaging could be used in application where visual security screening is needed without opening the packaging.

In Step 118, boxes 10 already prepared for shipping may be joined with other boxes prepared for shipping. The inflatable box 10 can be made for a single object or multiple in the same form factor. The flexibility of design allows to cluster multiple repetitions of the design together that are connected among themselves.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. An inflatable packaging box to protect an item during storage and shipment, comprising;

a plurality of adjoining plastic sidewalls;

a chamber formed within the plurality of plastic sidewalls adapted to receive the item;

an opening through at least one of the plurality of plastic sidewalls through which the chamber is accessible;

a plurality of flexible films each secured to one of the plurality of plastic sidewalls;

each of the plurality of flexible films forming one of a series of elongated sections which form the chamber in a space between the series of elongated sections such that outer edges of the elongated sections are interconnected with the plastic sidewalls where the adjoining plastic sidewalls intersect; and each of the series of elongated sections of flexible film being inflatable to conform to the item's shape;

the series of elongated sections of flexible films being inflatable through a sealed opening formed in one of the plastic sidewalls to accept inflation material to inflate the space between the one of the plastic sidewalls and one of the elongated sections of flexible film through holes in each of the elongated sections of flexible film to receive the inflation material to inflate the space between the remaining elongated sections of flexible film and the remaining plastic sidewalls.

2. The inflatable packaging box of claim 1 wherein each of the plurality of plastic sidewalls has a rectangular shape.

3. The inflatable packaging box of claim 2 wherein outer edges of the elongated sections are interconnected with the plastic sidewalls.

4. The inflatable packaging box of claim 3 wherein the plurality of flexible films are formed of flexible plastic and the plurality of plastic sidewalls are formed of non-stretchable plastic.

5. The inflatable packaging box of claim 4 wherein the inflatable packaging box has:

a first condition prior to the series of elongated sections being inflated; and a second condition wherein the series of elongated sections are inflated and conform to the item's shape.

6. The inflatable packaging box of claim 5 wherein the item is inserted through the opening and into the chamber when the inflatable packaging box is deflated and in the first condition.

7. The inflatable packaging box of claim 6 wherein the elongated sections are inflated in the second condition so that they conform to the shape of the item.

8. The inflatable packaging box of claim 7 wherein the space between the elongated sections and the plastic sidewalls can be inflated with an inflation material so that the sections of flexible film press against the item and substantially take the shape of the item.

9. The inflatable packaging box of claim 8 wherein a sealed opening formed in each of the sidewalls accepts the inflation material to inflate the space between the elongated sections and the sidewalls.

10. The inflatable packaging box of claim 8 including a seal member disposed over the opening through at least one of the plurality of plastic sidewalls after the item has been disposed within the chamber.

11. The inflatable packaging box of claim 10 wherein the inflatable packaging box is designed to be stackable, and modular to fasten together with other inflatable packaging boxes.

12. An inflatable packaging box to protect an item during storage and shipment, comprising;

a plurality of rectangular sidewalls, each formed of non-stretchable plastic;

a chamber formed within the plurality of rectangular sidewalls adapted to receive the item;

an opening through at least one of the plurality of rectangular sidewalls through which the chamber is accessible;

a plurality of flexible plastic films each secured to one of the plurality of rectangular sidewalls;

each of the plurality of flexible plastic films forming one of a series of elongated sections which form the chamber in a space between the series of elongated sections such that outer edges of the elongated sections are interconnected with the plastic sidewalls where the adjoining plastic sidewalls intersect; and each of the series of elongated sections of flexible plastic film being inflatable to conform to the item's shape;

the series of elongated sections of flexible films being inflatable through a sealed opening formed in one of the non-stretchable plastic sidewalls to accept inflation material to inflate the space between the one of the plastic sidewalls and one of the elongated sections of flexible film through holes in each of the elongated sections of flexible film to receive the inflation material to inflate the space between the remaining elongated sections of flexible film and the remaining plastic sidewalls.

13. The inflatable packaging box of claim 12 wherein the inflatable packaging box has:

a first condition prior to the series of elongated sections being inflated; and a second condition wherein the series of elongated sections are inflated and conform to the item's shape.

14. The inflatable packaging box of claim 13 wherein:

the item is inserted through the opening and into the chamber when the inflatable packaging box is deflated and in the first condition; and the elongated sections are inflated in the second condition so that they conform to the shape of the item.

15. The inflatable packaging box of claim 14 wherein the space between the elongated sections of flexible films and the plastic sidewalls can be inflated with an inflation material so that the sections of flexible film press against the item and substantially take the shape of the item.

16. The inflatable packaging box of claim 15 wherein a sealed opening formed in each of the sidewalls accepts the inflation material to inflate the space between the elongated sections and the sidewalls.

* * * * *